US006035858A

United States Patent [19]

Park

[11] Patent Number: 6,035,858

[45] Date of Patent: Mar. 14, 2000

[54] NAIL MANAGEMENT DEVICE AND CIRCUIT THEREFOR

[75] Inventor: Chung Hoon Park, Seoul, Rep. of Korea

[73] Assignee: Beaunix Co., Ltd., Seoul, Rep. of Korea

[21] Appl. No.: 09/346,367

[22] Filed: Jul. 1, 1999

[30] Foreign Application Priority Data

Nov. 11, 1998 [KR] Rep. of Korea ..... 98-48279

[51] Int. Cl.[7] ..... A45D 29/00

[52] U.S. Cl. ..... 132/73; 132/73.6; 132/73.5; 132/76.4

[58] Field of Search ..... 132/73.6, 73, 73.5, 132/74.5, 75.8, 76.4, 75; 15/97.1, 21.1, 22.1, 104.4, 167.1, 167.3; 401/219; 607/86, 85, 87

[56] References Cited

U.S. PATENT DOCUMENTS 5,640,979 6/1997 Trenary ..... 132/73
5,769,099 6/1998 Davis et al. ..... 132/73.5
5,797,407 8/1998 Davis et al. ..... 132/73.5
5,806,536 9/1998 Tietjen ..... 132/73
5,886,323 3/1999 Hivale ..... 132/73.5
5,921,250 7/1999 Rhea et al. ..... 132/73

*Primary Examiner*—Gene Mancene
*Assistant Examiner*—Pedro Philogene
*Attorney, Agent, or Firm*—Wells, St. John, Roberts, Gregory & Matkin, P.S.

[57] ABSTRACT

Disclosed is a nail management device and circuit therefor which can utilize an ultrasonic wave to thereby remove artificial nails from user's nails, separate the foreign materials under the nails, and massage the nails and hands of the user. The device includes: a case; a vessel body installed within the case, to receive a predetermined kind of solution therein; an ultrasonic wave generator installed on the one side of the vessel body, to generate an ultrasonic wave for producing oscillation such as a minute wave motion in the solution received in the vessel body; and a keypad for determining oscillation strength of the solution and as to whether the oscillation is generated in accordance with manipulation of the user.

5 Claims, 7 Drawing Sheets

NAIL MANAGEMENT DEVICE AND CIRCUIT THEREFOR

BACKGROUND OF THE INVENTION

1. Field of the Invention

The present invention relates to a nail management device and circuit therefor, and more particularly, to a nail management device and circuit therefor which can utilize an ultrasonic wave to thereby remove artificial nails from user's nails, separate foreign materials under the nails, and massage the nails and hands of the user.

2. Discussion of Prior Art

Women, generally, have their nails long to make their hands very beautiful. To elevate the beauty of their nails, in addition, they tint their long nails with various kinds of polish or paint simple and beautiful pictures on the nails.

As known, a predetermined period of time should elapse in order for the women to possess given length of nails. Moreover, a careful attention should be paid to manage the long nails in a clean state.

To readily overcome the inconvenience as mentioned above, therefore, artificial nails, commonly called 'tips', have been recently developed and used. Examples of the artificial nails are an ABS nail, nail using glass fiber, nail using gel or acrylic, nail using powder and the like.

A user applies an adhesive material over his or her nails and then attaches the artificial nails thereon. In this case, the attaching method of the artificial nail with the adhesive material may be of course replaced with other various kinds of methods.

FIG. 1 is a partial side sectional view illustrating the artificial nail attached over the front surface of the nail.

As shown in FIG. 1, an artificial nail 14 having a real nail shape is attached on the front surface of a nail 12, on which an adhesive material 16 is applied.

As the time elapses, the nail 12 on which the artificial nail 14 is attached is long. So, the artificial nail 14 is gradually distant from a finger 10 due to the growth of the nail 12, which results in degradation of the beauty of the nail.

To prevent the generation of the above problem, the user should remove the artificial nail 14, after a predetermined time elapses or if necessary. In this case, since the user forcibly removes the artificial nail 14 from the user's real nail 12, there occurs a problem that a damage on the nail 12 or the partial breakdown of the nail 12 may be generated.

Typically, on the other hand, after women do their hands or nails, they directly massage their hands alone, by using hand lotion or hand cream(or in a molten state).

Since the user directly massage her hands or nails alone, however, there occur some problems in that the time period required for the massage becomes long and a complete massage for the user's hands or nails is not possible.

Meanwhile, water is typically used to remove the dust or foreign materials in the nails or on the hands. At this time, in case of specific dusts or foreign materials, solution such as acetone is used. As yet, however, there is no method for removing the dusts or foreign materials in the nails in a more convenient manner.

To solve the above problems, the user tries to remove the artificial nail and the adhesive materials on her nail by putting her hand in a solvent such as a cold acetone. However, a complete removal of the artificial nail from the nail is not achieved, and in addition thereto, a considerable time period for the removal is required.

To overcome the problems suffered in the conventional nail management methods as mentioned above, there is a need to develop a novel nail management device which can prevent user's nails from being damaged at a time when artificial nails are removed out of the user's real nails, eliminate dusts or foreign materials under the nails or hands in an easy manner, and have a function of completely massaging the user's hands.

SUMMARY OF THE INVENTION

Accordingly, the present invention is directed to a nail management device and circuit therefor that substantially obviates one or more of the problems due to limitations and disadvantages of the related arts.

An object of the invention is to provide a nail management device and circuit therefor can easily remove artificial nails attached on user's real nails by means of the oscillation of an artificial nail removing solution or massage solution produced by using an ultrasonic wave, have a function of completely massaging the hands or nails of the user, and separate the dusts or foreign materials from the nails or hands of the user in an easy manner.

According to an aspect of the present invention, there is provided a nail management device including: a case; a vessel body installed within the case, to receive a predetermined kind of solution therein; an ultrasonic wave generator installed on the one side of the vessel body, to generate an ultrasonic wave for producing oscillation such as a minute wave motion in the solution received in the vessel body; and a keypad positioned on the panel of the front surface of the case, to output signals for determining oscillation strength of the solution and as to whether the oscillation is generated in accordance with manipulation of a user.

According to another aspect of the present invention, there is provided a nail management circuit including: a first power supply unit for rectifying and smoothing normal power inputted to supply a given direct current voltage; a second power supply unit for boosting the normal power inputted in accordance with the number of windings and rectifying and smoothing the boosted normal power to supply a given direct current voltage; a switching unit for performing a switch operation to generate an ultrasonic wave and determine the strength of the generated ultrasonic wave in accordance with the manipulation of a user; a control unit for outputting an ultrasonic wave oscillating control signal in response to the switching operation of the switching unit; an ultrasonic wave oscillator for generating a high frequency of electric oscillation in accordance with the ultrasonic wave oscillating control signal of the control unit; and an ultrasonic wave generator for converting the electric oscillation generated in the ultrasonic wave oscillator into a mechanical oscillation.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings.

In the drawings.

DETAILED DESCRIPTION OF PREFERRED EMBODIMENT

Reference will now be made in detail to the preferred embodiments of the present invention, examples of which are illustrated in the accompanying drawings.

Figure 1:
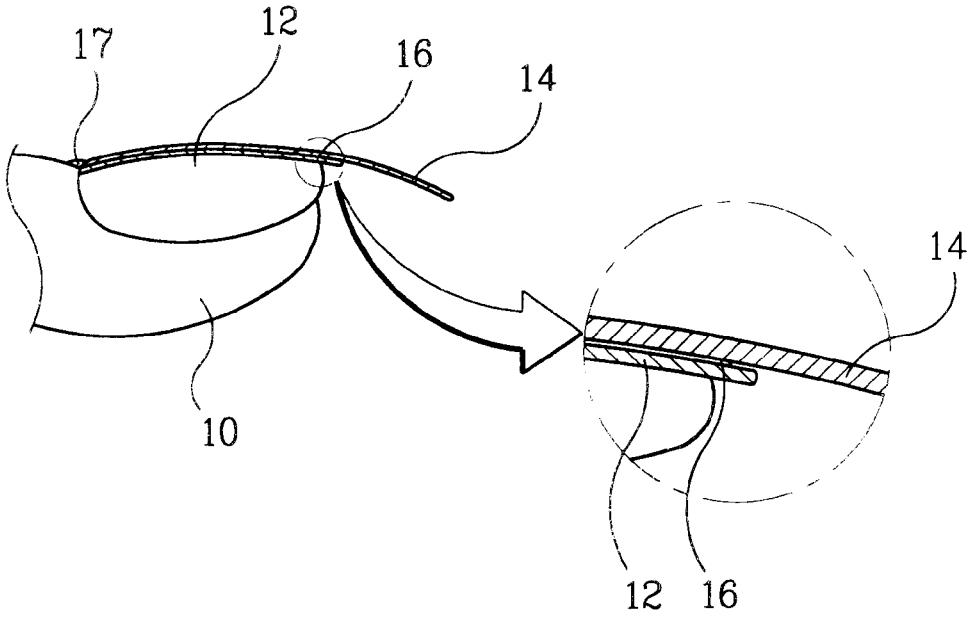
FIG. 1 is a partial side sectional view illustrating the artificial nail attached over the whole surface of the nail.
Figure 2:
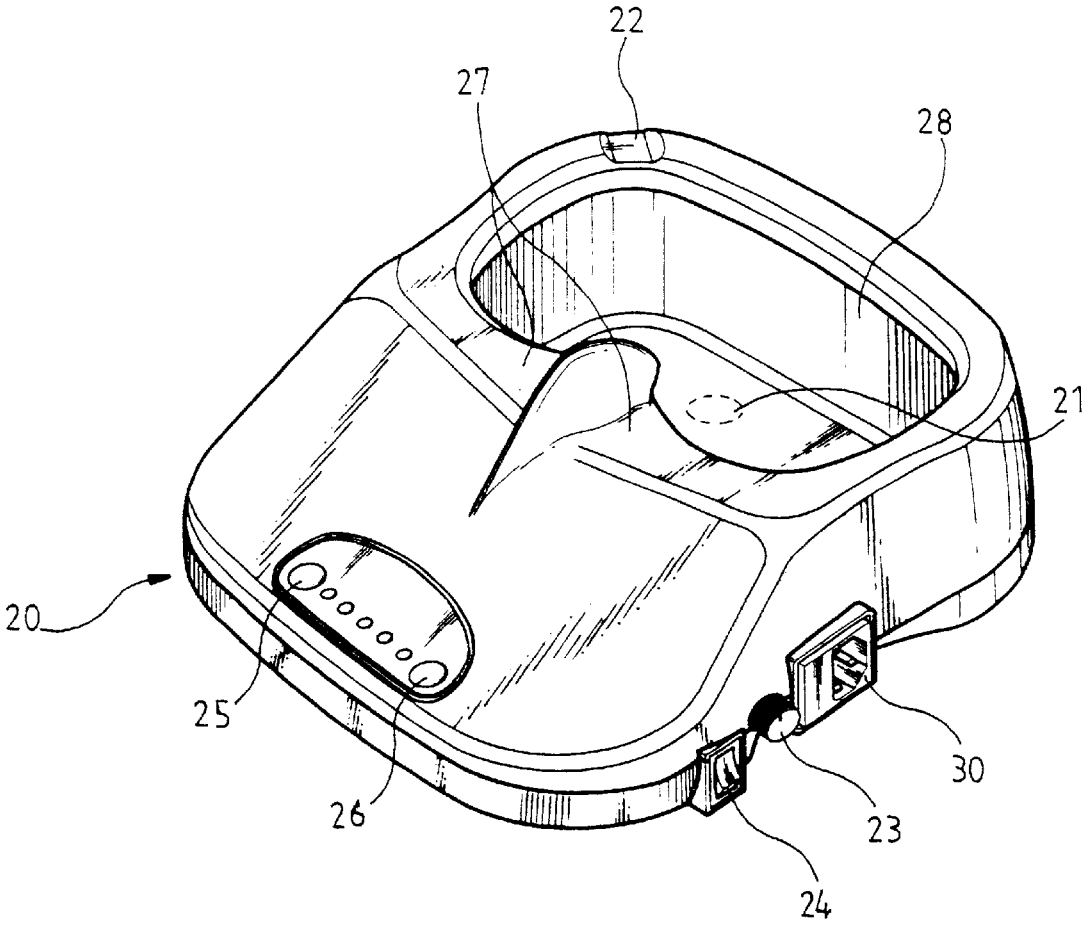
FIG. 2 is a perspective view illustrating a nail management device constructed in accordance with the present invention.

FIG. 2 is a perspective view illustrating a nail management device constructed in accordance with the present invention. A vessel body 28 is installed in the interior of a case 20, and where necessary, it can be attached/detached to and from the case 20.

The vessel body 28 is made of a stainless steel, and the case is made of plastic of PE~PP materials which is not molten by acetone. In case of assembling the vessel body 28 and the case 20, an adhesive silicon and a packing rubber having the durability against the acetone and solution are inserted between the vessel body 28 and the case 20, to thereby prevent the acetone and the solution from flowing to the interior of the device.

An ultrasonic wave generator 21 is provided on the center of the bottom surface of the vessel body 28. A power supply line is installed to be connected to the lower side of the vessel body 28, for supplying the power to the ultrasonic wave generator 21. If a plug is inserted into a power supply connector 30 which is arranged on a predetermined side surface of the case 20, the power is supplied to the device.

Within the vessel body 28, a solvent for melting the artificial nail, for example, acetone or a material where the acetone is contained is received. A groove is formed on the upper portion of the one side of the case 20, to which the solvent is guided to be ejected to the outside, after the removal of the artificial nail.

A coating layer is formed by means of a given coating material on the inner wall surface of the vessel body 28, to thereby prevent the vessel body 28 from being corroded due to the solvent retained therein.

A keypad 29, which is formed on the front surface of the case 20, has a start button 25 for activating the ultrasonic wave generator 21 and a time set button 26 for setting an oscillation time.

A plurality of lamps are provided between the start button 25 and the time set button 26, while not having any numbering. The plurality of lamps are by steps turned on/off, and the user recognizes whether the device for removing the artificial nail operates, through the operations of the lamps.

For instance, if the user turns on a power switch 24 which is installed on the side surface of the device for removing the artificial nail, a power lamp among the plurality of lamps is turned on. Also, the user presses the start button 25 and selects the desired time through the time set button 26, for example, among 5, 10 or 15 minutes, in accordance with the division of working types.

Then, if the time lamp indicative of the selected 5, 10 or 15 minutes and the start lamp are turned on, the nail management device of the present invention is ready to perform an artificial nail removing process, a foreign materials removing process, or a massage process.

Figure 3:
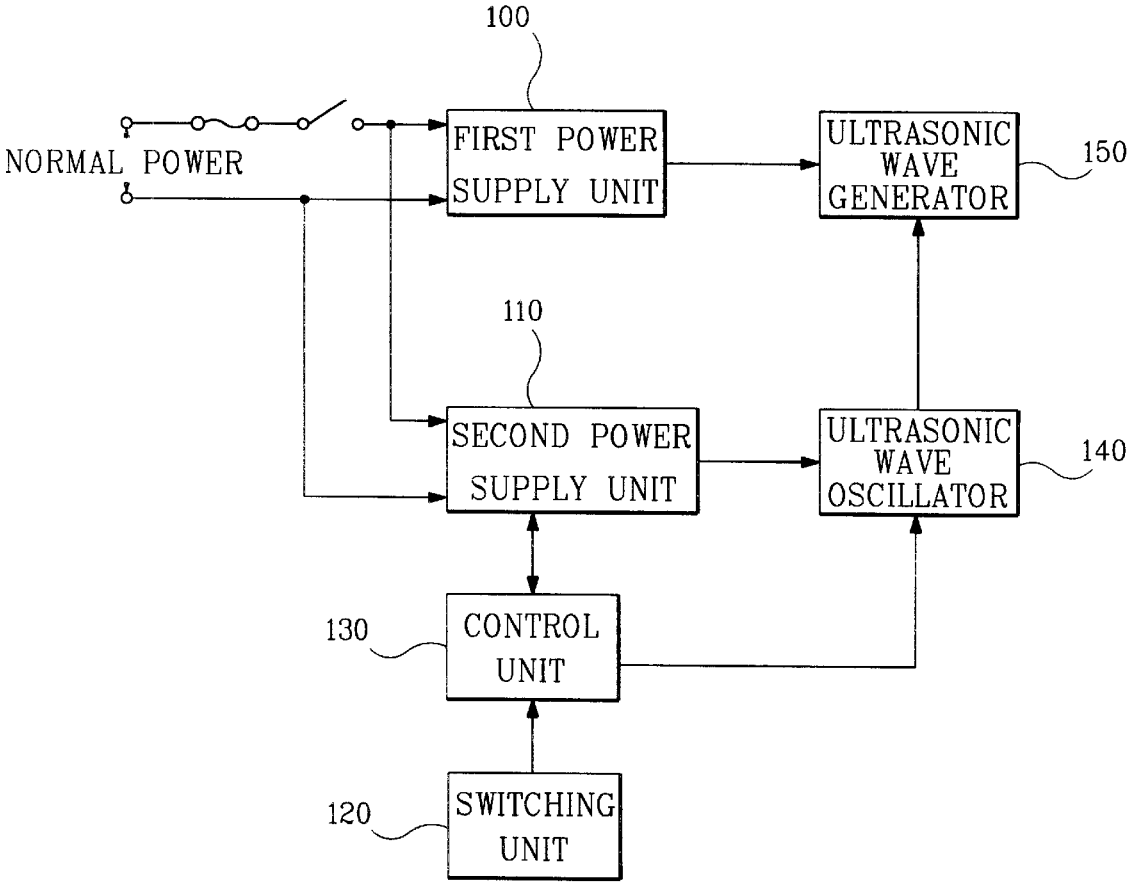
FIGS. 3 and 4 are block and circuit diagrams illustrating one embodiment of the circuit configurations of the nail management device constructed in accordance with the present invention.

At this time, the time intervals selected through the time set button 26 can be changed into any desired time intervals by varying the firmware installed in the interior of the microcomputer(U2 of FIG. 3).

If the set time by using the time set button 26 elapses at a time during the operation of the nail management device, the time and start lamps being turned on are automatically turned off. Also, the activation of the ultrasonic wave stops automatically.

If the artificial nail is not completely removed or in the case where the massage process or the cleaning process for removing the foreign materials under the nails is not satisfactory to the user, the start button 25 and the time set button 26 are re-pressed to repeat the above process.

As shown in FIG. 2, on the other hand, a hand mounting portion 27 is formed on the upper portion of the case 20 in such a manner that the palms of the user's hands are contacted on the hand mounting portion 27, thereby putting both hands of the user in the solvent.

As a result, the solvent is oscillated by means of the ultrasonic wave generated from the ultrasonic wave generator 21 and it has a high degree of collision against the nail 12 due to the oscillation of the solvent. Therefore, the adhesive material 16 attached on the nail 12 is dissolved in a short time and the artificial nail 14 is easily removed.

In a preferred embodiment of the present invention, a wavelength and temperature adjustor 23 is provided on the one side of the case 20, for adjusting the wavelength and temperature of the solvent within the vessel body 28.

In more detail, the wavelength and temperature adjustor 23 is arranged on the side surface of the case 20 in such a manner that if the wavelength of the solvent is increased, the temperature thereof is high, at the same time. If the wavelength and temperature adjustor 23 operates, the ultrasonic wave generator 21 generates a weak or strong ultrasonic wave by steps. By using the wavelength and temperature adjustor 23, the user can adjust the wavelength and temperature of the solvent retained in the vessel body 28, if necessary.

Desirably, the temperature of effectively removing the artificial nail 14 is about 25° C. to 45° C., which is involved in a volume temperature range which can be felt warm and not affected on the figures of the user.

In accordance with the contents of the vessel body 28, the nail management device of the present invention can be used as an artificial nail removing device, hand and nail massage device, and hand and nail cleaning device.

By way of example, in the case where the vessel body 28 receives the acetone therein, the nail management device of the present invention can be embodied as the artificial nail removing device, in case of the hand lotion or hand cream mixed with water, the device as the hand and nail massage device, and in case of the acetone or a cleaning material mixed with water, the device as the hand and nail cleaning device.

Now, an explanation of the foreign materials on the nails, which are difficult to be removed, will be in detail discussed. In general nail shops, a cuticle 17 on the root of the fingernail or toenail is removed after doing the nail.

To easily remove the cuticle 17, a cuticle oil is firstly covered and the cuticle 17 is then removed. After the removal of the cuticle 17, however, the cuticle oil is difficult to be readily removed.

At this time, after acetone or hand cleanser is poured in the interior of the vessel body 28, if the nail management device of the present invention operates, a minute ultrasonic wavelength is generated, which causes the cleanser to be oscillated to thereby remove the foreign materials under the nail and the cuticle oil in an effective manner.

At a time when the nail polish is removed in the nail shop, if the acetone is poured in the vessel body 28 and the ultrasonic wave is generated, the foreign materials under the nail can be completely removed.

As discussed above, the ultrasonic wave is needed to remove the artificial nail, massage the hand, or remove the foreign materials in the nail. FIG. 3 shows a circuit diagram of the nail management device according to the present invention, for generating the ultrasonic wave.

Figure 4:
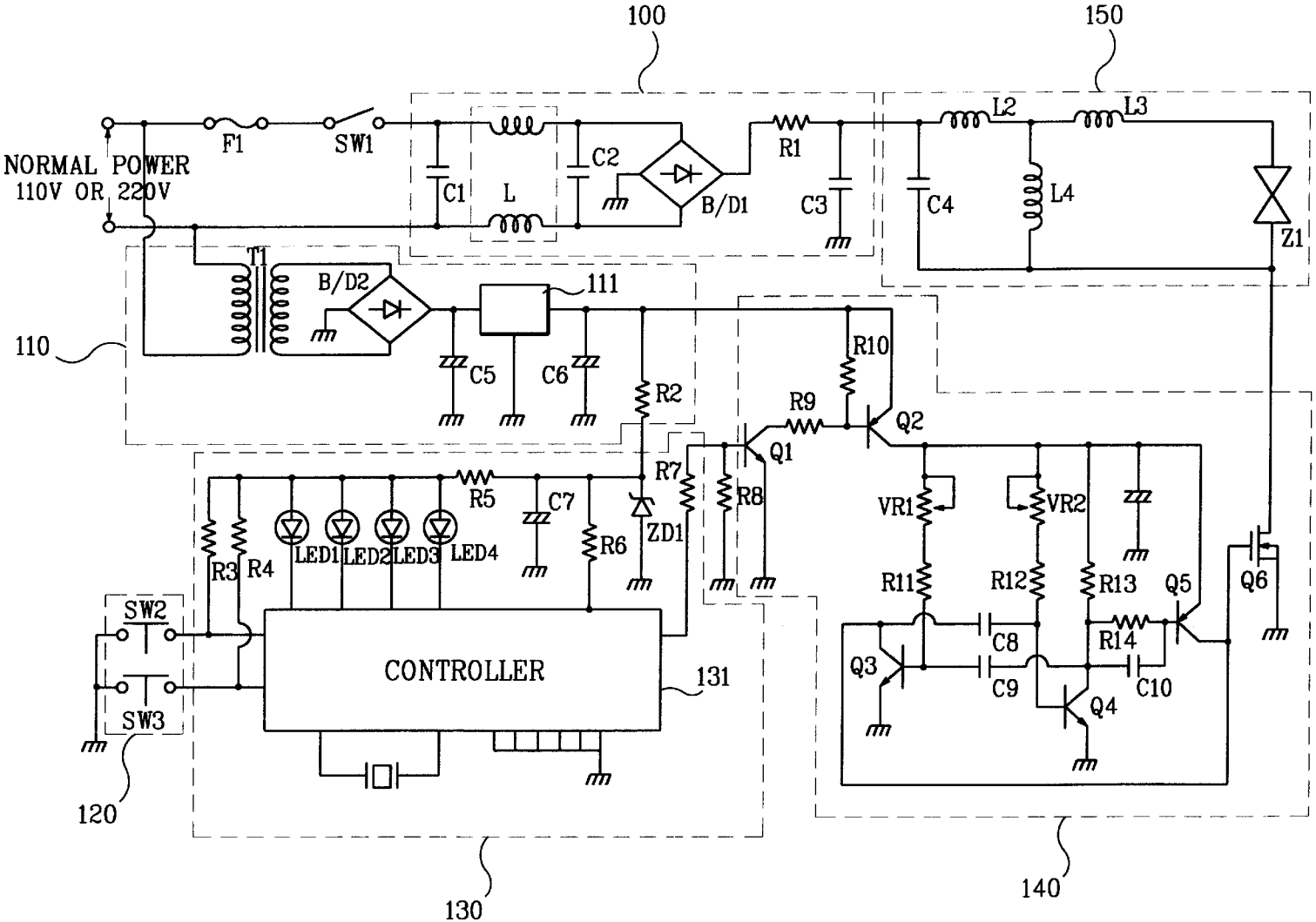

FIGS. 3 and 4 are block and circuit diagrams illustrating one embodiment of the circuit configurations of the nail management device constructed in accordance with the present invention.

As shown in FIG. 3, a nail management circuit of the present invention includes: a first power supply unit 100 for rectifying and smoothing normal power inputted to supply a given direct current voltage; a second power supply unit 110 for boosting the normal power inputted in accordance with the number of windings and rectifying and smoothing the boosted normal power to supply a given direct current voltage; a switching unit 120 having a plurality of switches SW2 and SW3, for performing a switch operation to generate an ultrasonic wave and determine the strength of the generated ultrasonic wave in accordance with the manipulation of a user; a control unit 130 for outpufting an ultrasonic wave oscillating control signal in response to the switching operation of the switching unit 120; an ultrasonic wave oscillator 140 for generating a high frequency of electric oscillation in accordance with the ultrasonic wave oscillating control signal of the control unit 130; and an ultrasonic wave generator 150 for converting the electric oscillation generated in the ultrasonic wave oscillator 140 into a mechanical oscillation.

As shown in FIG. 4, the first power supply unit 100 is comprised of: a fuse F1 for protecting the circuit at the back stage from overvoltage inputted; a power supply switch SW1 for supplying power to the whole circuit in accordance with users manipulation; a filter 101 having a plurality of condensers C1 and C2 and a plurality of coils L1 and L2, for filtering the inputted power from the power supply switch SW1; a bridge diode B/D1 a for converting alternating current(AC) outputted from the filter 101 into a direct current(DC); and a condenser C3 for smoothing the DC outputted from the bridge diode B/D1.

A reference symbol R1 denotes a bias resistor.

The second power supply unit 110 is comprised of: a transformer T1 for boosting the inputted power; a bridge diode B/D2 for converting the AC outputted from the transformer T1 into a DC; a stabilizing circuit part 111 for stabilizing the DC inputted from the bridge diode B/D2; a condenser C5 for smoothing the DC outputted from the bridge diode B/D2; and a condenser C6 for smoothing the DC outputted from the stabilizing circuit part 111.

A reference symbol R6 denotes a resistor.

First to fourth light emitting diodes LED1~LED4 which are included in the control unit 130 are turned on/off in response to a driving signal of a controller 131, to thereby inform the user of the operation state of the artificial nail removing device.

Reference symbols R3 and R4 denote a bias resistor, and a Zener diode ZD1 is an element for controlling the power supplied to the first to fourth light emitting diodes LED1~LED4. Condenser C7 and resistor R5 are a smoothing circuit part.

The ultrasonic wave oscillator 140 is comprised of: a transistor Q1 which is turned on by inputting the ultrasonic wave oscillation signal of the control unit 139; a transistor Q2 which is engaged in accordance with the driving of the transistor Q1, for selectively receiving the power outputted from the second power supply unit 110; first and second variable resistors VR1 and VR2 for varying the power supplied by the transistor Q2; transistors Q3 and Q4 which are driven in response to the varied voltage; and a transistor Q5 which is engaged in the transistors Q3 and Q4, for supplying the power of the second power supply unit 110 to a field effect transistor Q6.

In operation, if the power switch SW1 is turned on by the manipulation of the user, the normal power of 110 volts or 220 volts is inputted, rectified and smoothed in the first power supply unit 100. The smoothed DC is supplied as a driving power of a piezo-resonator Z1 by means of coils L2~L4 of the ultrasonic wave generator 150.

Simultaneously, the normal power is supplied to the second power supply unit 110 and is boosted by means of the transformer T1 to be thereby inputted to the ultrasonic wave oscillator 140 for generation of the ultrasonic wave.

In the state where the power has been supplied mode set switches SW2 and SW3 are used to determine the strength of ultrasonic wave.

The microcomputer U2 of the control unit 130 outputs an oscillation driving signal to the ultrasonic wave oscillator 140 in response to the signals of the mode set switches SW2 and SW3. Next, the ultrasonic wave oscillator 140 generates strong, intermediate, or weak ultrasonic wave in response to the oscillation driving signal.

The oscillation driving signal is a rectangular wave signal, and the microcomputer U2 outputs the rectangular wave signal having different duty ratios in accordance with the mode. The rectangular wave signal outputted from the control unit 130 is inputted to the base terminal of the NPN transistor Q1 of the ultrasonic wave oscillator 140, which is turned on only during the on-duty period of the rectangular wave signal.

If the transistor Q1 is turned on, the base terminal of the PNP transistor Q2, which is connected to the collector terminal of the transistor Q1, pulls-down to a zero voltage. Accordingly, the transistor Q2 is turned on, and the voltage generated by the second power supply unit 110 is supplied to the rear stage of the ultrasonic wave oscillator 140.

The power supplied is provided to the field effect transistor Q6 for driving the transistor Q6, in which a high frequency of electric oscillation is produced. The electric oscillation is outputted to the one side terminal of the piezo-resonator Z1 of the ultrasonic wave generator 150, in which the electric oscillation is converted into the mechanical oscillation.

Hence, the solvent, which is reserved in the vessel body 28 to remove the artificial nails, surges by the generation of oscillation of the piezo-resonator Z1, thus to easily remove the artificial nail attached on the nail with the help of the minute wavelength of the oscillation.

Figure 5:
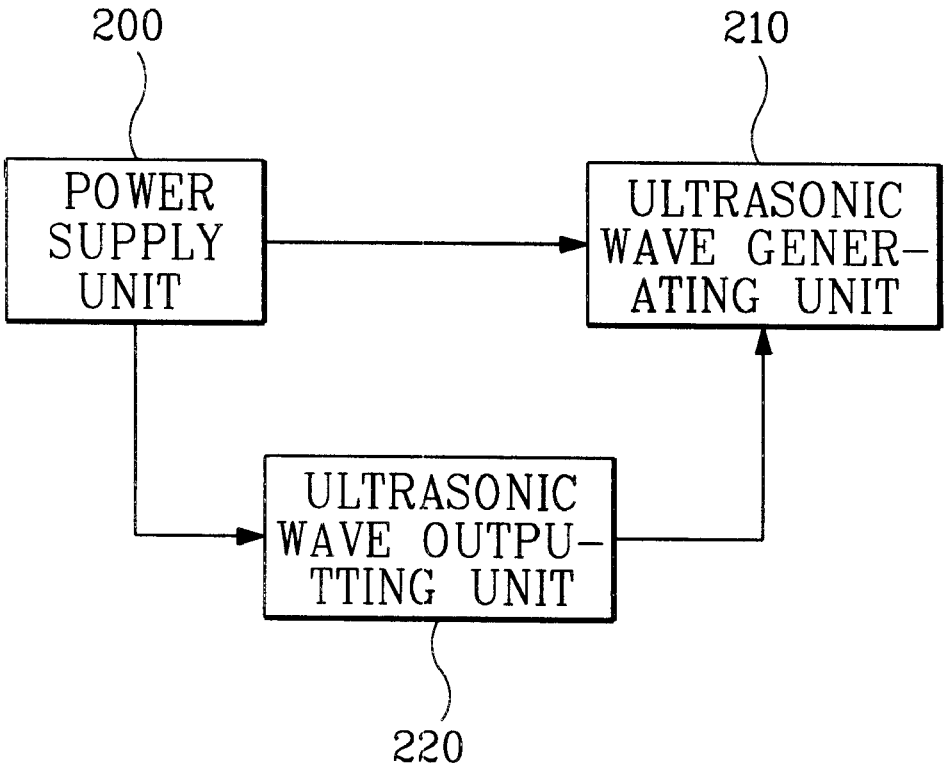
FIGS. 5 and 6 are block and circuit diagrams illustrating another embodiment of FIGS. 3 and 4.
Figure 6:
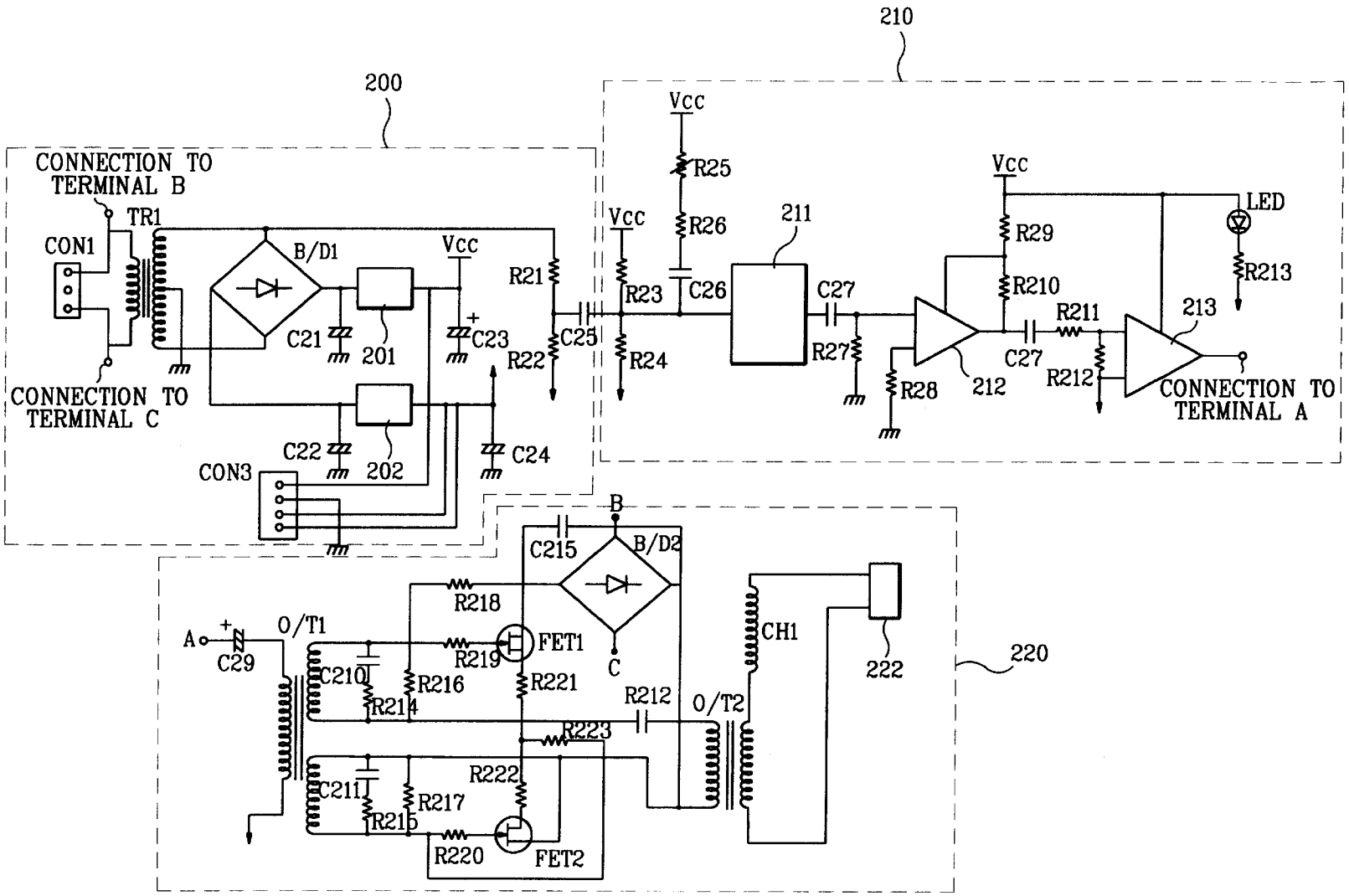

FIGS. 5 and 6 are block and circuit diagrams illustrating another embodiment of FIGS. 3 and 4.

As shown in FIG. 5, a nail management circuit of the present invention includes: a power supply unit 200 for rectifying and smoothing normal an AC power inputted from the outside to thereby supply a given DC voltage; an ultrasonic wave generating unit 210 for receiving the power of the power supply unit 200 to generate an ultrasonic wave signal; and an ultrasonic wave outputting unit 220 for phase-modulating and amplifying the ultrasonic wave signal generated in the ultrasonic wave generator 210.

The power supply unit 200 is comprised of: a first transformer TR21 for down-converting the inputted AC voltage into a voltage of a low state; a bridge diode B/D21 for converting the AC voltage down-converted to the low voltage into a DC voltage; condensers C21 and C22 for smoothing the DC voltage converted in the bridge diode B/D21; stabilizing circuit parts 201 and 202 for stably supplying the DC voltage converted in the bridge diode B/D21; condensers C23 and C24 for removing ripple component of the DC outputted from the stabilizing circuit parts 201 and 202; and a timer power supply unit 204 for supplying the power outputted from the stabilizing circuit parts 202 to a timer, in response to the input signal from the timer.

Reference symbols R21 and R22 denote voltage-distribution resistors, and a condenser C26 is a filtering element.

The ultrasonic wave generating unit 210 is comprised of: distribution resistors R23 and R24 for distributing a power supply voltage Vcc; a variable resistor R25 for tuning a frequency of ultrasonic wave, while increasing or decreasing by steps the ultrasonic wave in accordance with the manipulation of the user; an ultrasonic wave generating circuit part 211 for generating the ultrasonic wave signal by using the variation of voltage inputted from the power supply unit 200; and a primary amplifier 212 for performing a primary amplification for the ultrasonic wave signal generated in the ultrasonic wave generating circuit part 211.

The variable resistor R25 performs the tuning operation for the frequency ranged from 10 kHz to 80 kHz. Therefore, a piezoelectric element 222 as will be discussed hereinafter is oscillated with the tuned frequency.

The amplifying circuit part 212 has a plurality of resistors R26~R212, condensers C29 and C212, a plurality of amplifiers AMP21 and AMP22.

The ultrasonic wave outputting unit 220 is comprised of: a second transformer O/T21 for separating an output terminal of the ultrasonic wave generating unit 210 from an input terminal of the ultrasonic wave outputting unit 220, to thereby generate an output signal at the gate terminal thereof; condensers C210 and C211 and resistors R214 and 215 for reducing sparks generated by the output signal of the second transformer O/T21; a secondary amplifier 221 having a plurality of field effect transistors FET21 and FET22 and driven by the gate signal of the second transformer O/T21, for performing a secondary amplification for the ultrasonic wave signal which completes the primary amplification; a second bridge diode B/D22 for converting AC power inputted from the outside into DC power to thereby supply the DC power to the primary side of the first transformer TR21; a condenser C215; a third transformer O/T22 for outputting an oscillator driving signal by using the ultrasonic wave generated in the secondary amplifier 221; and the piezoelectric element 222 connected to the secondary side windings of the third transformer O/T22, for generating the ultrasonic wave on an LC resonance.

Reference symbols R218~R223 denote bias resistors.

In operation, if a plug(not shown) of the nail management device of the present invention is inserted into a dedicated receptacle, the AC voltage as the normal power is converted via the second bridge diode B/D22 of the ultrasonic wave outputting unit 220 and the condenser C25 into the DC voltage.

The DC voltage is supplied to the primary side windings of the first transformer TR21 of the power supply unit 200. The energy is accumulated on the primary side windings of the first transformer TR21, so it is left in the secondary side windings thereof.

The AC voltage produced by the first transformer TR21 is converted into the DC voltage, through the first bridge diode B/D21 and the condensers C21 and C22, respectively. Then, the DC voltage is stabilized at the stabilizing circuit parts 201 and 202, and the ripple component of the DC voltage is removed through the condensers C23 and C24, respectively. Next, the DC voltage is supplied to the ultrasonic wave generating unit 210 and the timer.

Thereafter, the DC voltage is inputted to the ultrasonic wave generating circuit part 211, which generates the ultrasonic wave signal having the tuned frequency by means of the variable resistor R25.

The ultrasonic wave signal is amplified by means of the plurality of amplifiers AMP21 and AMP22, and is then outputted to the ultrasonic wave outputting unit 220. Next, the ultrasonic wave signal is supplied via the condenser C29 to the primary side windings of the second transformer O/T21.

Therefore, a predetermined voltage is left in the secondary side windings of the second transformer O/T21, and the sparks generated due to the left predetermined voltage is reduced by means of the resistors R214 and R215 and the condensers C210 and C211. Then, the voltage where the sparks are reduced is supplied to the gate terminal of the field effect transistors FET21 and FET22 as the secondary amplifier 221.

The inputted voltage is amplified in the field effect transistors FET21 and FET22 and is supplied to the primary side windings of the third transformer O/T22. Thereby, the voltage left in the secondary side windings thereof is induced to a choke coil CH21.

Therefore, a predetermined resonance is produced by means of the choke coil CH21 and the piezo-electric element 222, so that the solvent, which is retained in the vessel body 28 of the nail management device of the present invention, generates a predetermined amount of oscillation. The generated oscillation enables the solvent to be dynamically contacted with the user's nails, thus removing the artificial nails from the nails within a rapid time period.

Under the construction as above, of course, the nail management device of the present invention may be usefully applied in the case where the user 's hands are massaged.

Figure 7:
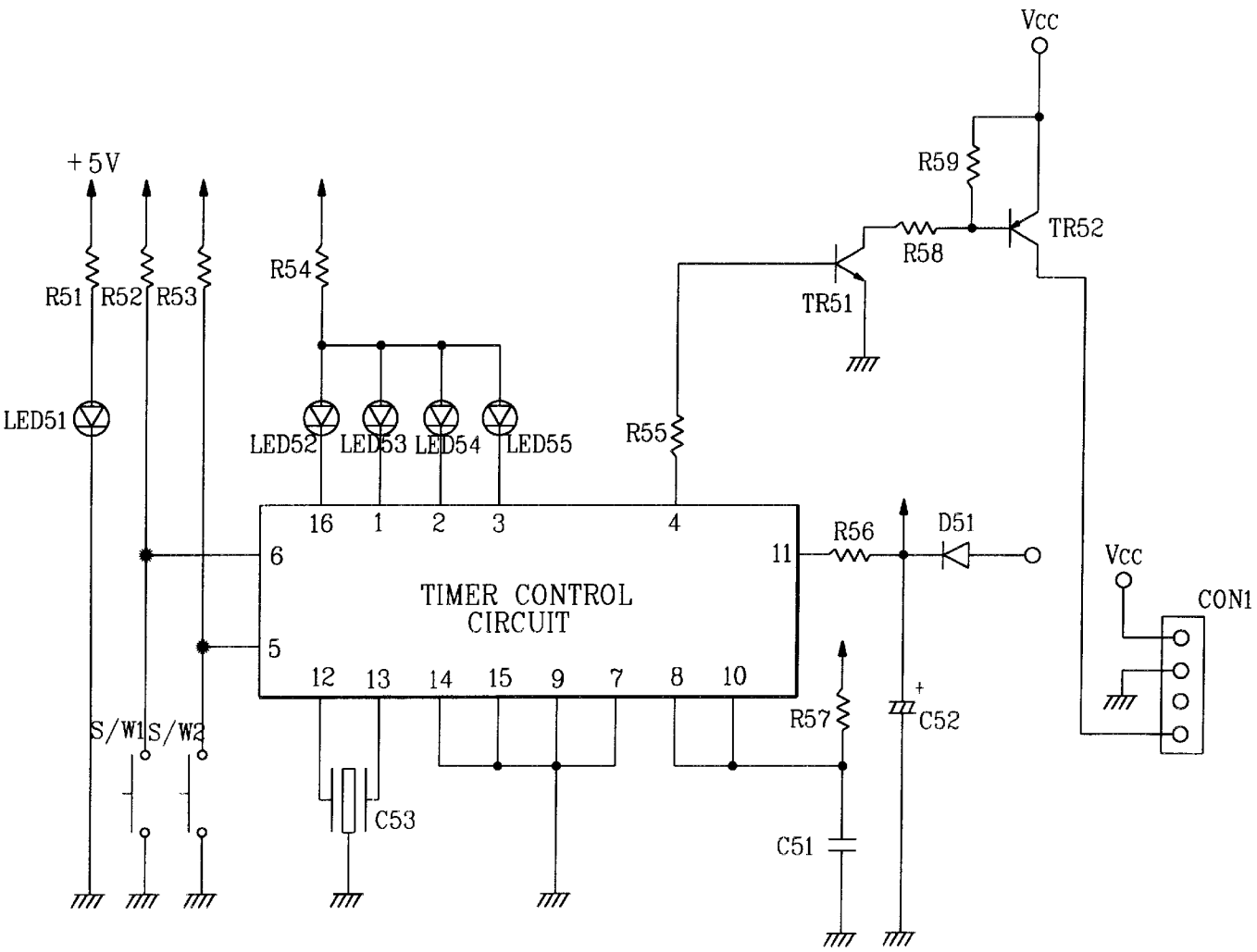
FIG. 7 is a circuit diagram illustrating the timer embodied in FIGS. 5 and 6.

FIG. 7 is a circuit diagram illustrating the timer embodied in FIGS. 5 and 6. The timer is arranged to check the time so as for the nail management device of the present invention to operate within the operation time set by the user. The timer utilizes the power supplied from the power supply unit 200 as a driving power.

Reference symbols S/W1 and S/W2 represent switches, and the switching signal inputted according to the manipulation of the user controls as to whether the nail management device is driven.

Reference symbols LED51~LED55 are light emitting diodes and are turned on/off to visibly inform the user whether the nail management device is driven.

Reference symbols R51~R59 denote bias resistors.

Transistors TR51 and TR52 are driven in accordance with a driving signal at a logic "high" state outputted in a timer control circuit to thereby output the ultrasonic wave oscillation signal generated from the timer to the receptacle CON3 of the power supply unit 200 of FIG. 4. Then, the power supply unit 200 controls the whole system of the nail management device in response to the ultrasonic wave oscillation signal and the AC power inputted.

As clearly apparent from the foregoing, a nail management device and circuit therefor according to the present invention includes a solvent which can remove artificial nails, perform a hand massage function, or separate foreign materials under nails by using an ultrasonic wave generator and a wavelength and temperature adjustor, to thereby achieve the above functions in a more convenient manner.

It will be apparent to those skilled in the art that various modifications and variations can be made in a nail management device and circuit therefor of the present invention without departing from the spirit or scope of the invention. Thus, it is intended that the present invention cover the modifications and variations of this invention provided they come within the scope of the appended claims and their equivalents.

What is claimed is:

1. A nail management device for removing an artificial nail attached on the front surface of a nail, said device comprising:

a case;

a vessel body installed within said case, to receive a predetermined kind of solution therein;

an ultrasonic wave generator installed on the one side of said vessel body, to generate an ultrasonic wave for producing oscillation in the solution received in said vessel body; and a keypad positioned on the panel of the front surface of said case, to output signals for determining oscillation strength of the solution and as to whether the oscillation is generated in accordance with manipulation of a user.

2. The device as claimed in claim 1, further comprising a time set unit for setting an operation time of said ultrasonic wave generator.

3. The device as claimed in claim 1, further comprising a wavelength and temperature adjustor for adjusting wavelength strength of the ultrasonic wave generated from said ultrasonic wave generator and temperature of the solution.

4. The device as claimed in claim 1, wherein said keypad further comprises a plurality of light emitting diodes for displaying each driving state of the whole system.

5. The device as claimed in claim 1, wherein said wavelength of the ultrasonic wave is varied by steps in accordance with the manipulation of the user.

* * * * *